United States Patent [19]

Hanneman et al.

[11] 4,197,145

[45] Apr. 8, 1980

[54] ZIRCONIUM-BASE ALLOY STRUCTURAL COMPONENT FOR NUCLEAR REACTOR AND METHOD

[75] Inventors: Rödney E. Hanneman, Burnt Hills; Daeyong Lee; Craig S. Tedmon, Jr., both of Scotia, all of N.Y.

[73] Assignee: General Electric Company, Schenectady, N.Y.

[21] Appl. No.: 934,948

[22] Filed: Aug. 18, 1978

Related U.S. Application Data

[63] Continuation of Ser. No. 535,419, Dec. 23, 1974, abandoned.

[51] Int. Cl.[2] ..... C22C 16/00; C22F 1/18

[52] U.S. Cl. ..... 148/11.5 F; 75/177; 148/32.5; 148/133; 176/88; 176/91 R

[58] Field of Search ..... 148/11.5 F, 12.7, 32, 148/32.5, 133; 75/177; 176/67, 88, 91

[56] References Cited

U.S. PATENT DOCUMENTS

| | | | |
|---|---|---|---|
| 2,894,866 | 7/1959 | Picklesimes | 148/133 X |
| 3,005,706 | 10/1961 | Thomas et al. | 75/177 |
| 3,125,446 | 3/1964 | Johnson et al. | 75/177 |
| 3,150,972 | 9/1964 | Rösler | 75/177 |
| 3,261,682 | 7/1966 | Rösler | 75/177 |
| 3,865,635 | 2/1975 | Hofvenstam | 148/11.5 F |

FOREIGN PATENT DOCUMENTS 859053 12/1970 Canada ..... 75/177

OTHER PUBLICATIONS

Goodwin, "Bettis Technical Review," WAPD-BT-6, Jan. 1958, *Reactor Metallurgy*, pp. 39–47.

Chirigos et al., "Development of Zircaloy 4, Proceedings of a Symposium," Vienna, May 1960, vol. 1, pp. 19, 24, 32, 38, 40, 41, 44, 45, 52 & 53.

"The Corrosion of LWBR Zircaloy End Cap Weldments," AEC Contract Report AT-11-1-GEN-14, Feb. 1973, WAPD-TM-1972, Abstract, pp. 7, 9 & 24.

Welding Research Supplement, Jan. 1956, pp. 27s to 31s.

*Primary Examiner*—L. Dewayne Rutledge
*Assistant Examiner*—Peter K. Skiff
*Attorney, Agent, or Firm*—Leo I. MaLossi; James C. Davis, Jr.

[57] ABSTRACT

A small amount of lanthanum and praseodymium will substantially improve the slow strain rate ductility of certain zirconium-base alloys and these new alloys and certain other zirconium-base alloys in the irradiated condition can under certain circumstances have surprising load-carrying capacity and service life. Such other alloys contain yttrium or calcium instead of lanthanum or praseodymium.

3 Claims, 2 Drawing Figures

ZIRCONIUM-BASE ALLOY STRUCTURAL COMPONENT FOR NUCLEAR REACTOR AND METHOD

This is a continuation of application Ser. No. 535,419, filed Dec. 23, 1974, abandoned.

The present invention relates generally to the materials of construction of nuclear reactors and is more particularly concerned with zirconium-base alloy nuclear reactor structural components having superior mechanical properties and unusually long service lives.

CROSS REFERENCE

This invention is related to that disclosed and claimed in copending application Ser. No. 535,271, abandoned filed Dec. 23, 1974 in the name of Daeyong Lee which is based upon the concept of using beryllium in small amount to substantially increase the useful service life of nuclear reactor structural components of zirconium-base alloys, and on the additional concept of heat treating the beryllium-containing alloy in a manner which substantially increases the stress-corrosion resistance of the alloy under boiling water reactor conditions.

BACKGROUND OF THE INVENTION

Important requirements for materials used in boiling water nuclear reactor construction include low absorption for thermal neutrons, corrosion and stress-corrosion resistance and mechanical strength. Zirconium-base alloys sufficiently satisfy these requirements that they are widely used for such purposes, "Zircaloy-2" (containing about 1.5 percent tin, 0.15 percent iron, 0.1 percent chromium, 0.05 percent nickel and 0.1 percent oxygen) and "Zircaloy-4" (containing substantially no nickel but otherwise similar to Zircaloy-2) being two of the important commercial alloys commonly finding such use. These alloys, however, are not nearly all that one would desire, particularly in respect to useful service life, despite many efforts of others during the past two decades to improve them. Mainly, these efforts have been aimed at improving corrosion resistance and usually this has involved changes in composition. Thus, in U.S. Pat. No. 3,005,706, it is proposed that from 0.03 to 1.0 percent of beryllium be added to zirconium alloys intended for use in conventional boilers, boiling water reactors and similar apparatus. Similarly, in U.S. Pat. Nos. 3,261,682 and 3,150,972, cerium and/or yttrium, and calcium, respectively, are proposed as zirconium alloy additions in like proportions for the same purpose. Accounts and reports of the results of such compositional changes are sparse, however, and the present commercial alloys do not include any of these additional constituents.

The literature in this field, however, contains little concerning efforts to improve upon the mechanical strength of zirconium-base alloys and particularly the load-carrying capacity of fuel cladding and other reactor parts subjected to prolonged exposure to typical boiling water reactor conditions. This is in spite of the fact that it has long been general knowledge that slow strain rate ductility of these alloys is lost to a great extent as a result of radiation exposure over periods of a year or more. The problem of premature termination of service life because of fast neutron radiation-induced embrittlement is particularly aggravated in the case of nuclear fuel containment channels and tubes or cladding. The natural swelling of the fuel as it is burned produces high localized stresses leading to stress-corrosion cracking of the cladding at a time before corrosion of the type described in the above patents might normally necessitate cladding replacement.

THE INVENTION

This invention is based upon our novel concept of removing dissolved interstitial oxygen from a zirconium matrix by the addition of a small amount of one or another of several elements capable of converting such oxygen to a form in which it cannot exert short-range forces on dislocations to produce a phenomenon similar to the Protevin-LeChatelier effect. Lanthanum, praseodymium, yttrium and calcium are all suitable for this purpose and may be used individually or together in any combination in an aggregate amount of 500 parts per million to 0.25 weight percent.

This invention is also based on our concept that the addition of one or more of these four metals will lead to surprising improvement in the load-carrying capacity (uniform stress to maximum load) of zirconium-base alloy bodies subjected to fast neutron radiation for a year or more. Consequently, as in the case of the addition of a small amount of beryllium to such an alloy described in the referenced patent application, the service life of nuclear reactor structural components can thereby by increased substantially.

As another aspect of this invention, resistance to corrosion under boiling water reactor conditions resulting in heavy oxide coating formation may be substantially reduced or limited through a special heat treatment procedure. Thus, without any offsetting detrimental effect on mechanical or other properties or characteristics, structural components of the alloys of this invention are heated to a temperature of the order of 900° C. for a short time to effect a partial transformation of alpha to beta phase. A water quench immediately follows. In addition to materially increasing resistance to corrosion, this process enhances alloy ductility as described in the above-referenced patent application.

In its method aspect, this invention briefly described includes the steps of providing a zirconium-base alloy nuclear reactor structural component in which the alloy contains from 0.05 to 0.25 weight percent lanthanum, praseodymium, yttrium and calcium, heating the structural component to a temperature above 900° C., then quenching it, and finally subjecting it to boiling water reactor conditions for a year or more.

In its product or article aspect, this invention takes the form of a nuclear reactor structural component of a zirconium-base alloy containing from 0.05 to 0.25 weight percent of lanthanum or praseodymium or mixtures thereof and at least 95 weight percent zirconium. As a variation within the scope of this invention, the product is a nuclear fuel container in the form of an elongated tubular body of a zirconium-base alloy containing 0.05 to 0.25 weight percent yttrium, praseodymium, calcium or lanthanum or mixtures of two or more of them and at least 95 weight percent zirconium, the alloy having microstructure in which an intermetallic phase is segregated at grain boundaries. Still further, the product of this invention is a fuel container which in the irradiated condition has substantially greater load-carrying capacity than a counterpart fuel container irradiated to the same extent but containing no yttrium, praseodymium, calcium or lanthanum.

DETAILED DESCRIPTION OF THE INVENTION

Figure 1:
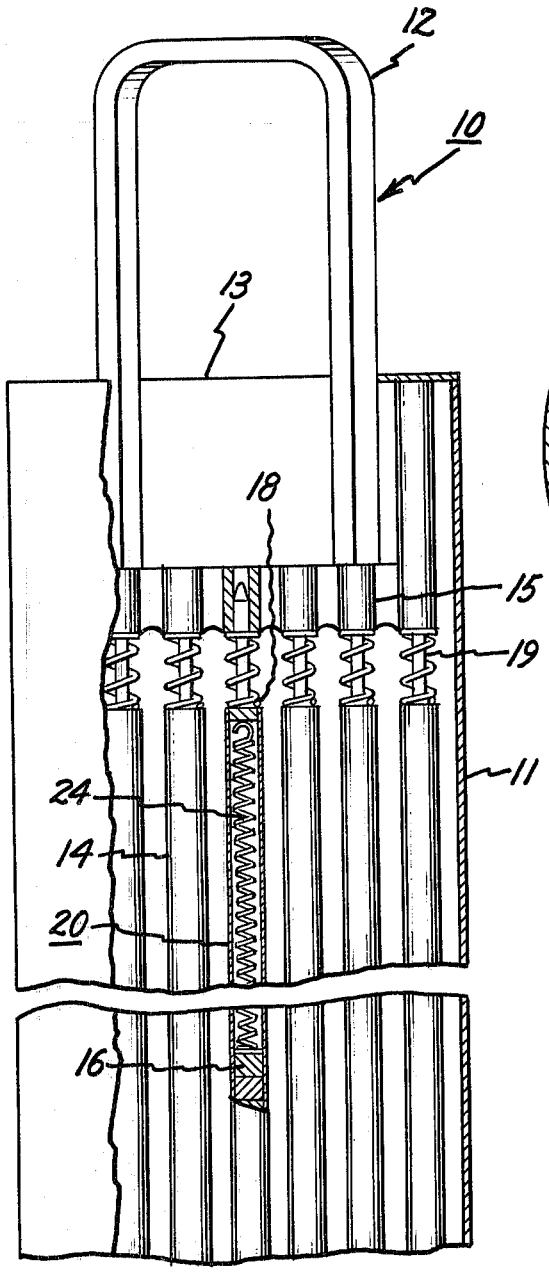
FIG. 1 presents a partial cutaway sectional view of a nuclear fuel assembly containing nuclear fuel elements constructed according to the teaching of this invention.
Figure 2:
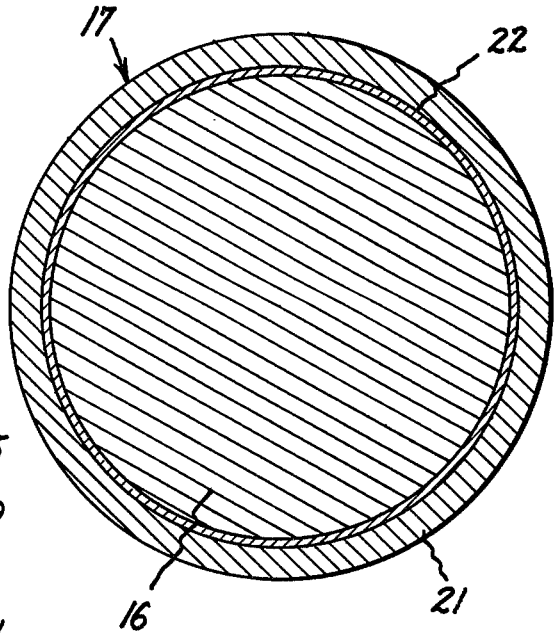
FIG. 2 presents an enlarged cross-sectional view of the nuclear fuel element in FIG. 2.

As indicated by FIG. 1, a primary application of the present invention is for the fabrication of nuclear fuel assemblies such as that illustrated at 10 consisting of a tubular flow channel 11 of generally square cross section provided at its upper end with lifting bale 12 and at its lower end with a nose piece (not shown due to the lower portion of assembly 10 being omitted). The upper end of channel 11 is open at 13 and the lower end of the nose piece is provided with coolant flow openings. An array of fuel elements or rods 14 is enclosed in channel 11 and supported therein by means of upper end plate 15 and a lower end plate (not shown due to the lower portion being omitted). The liquid coolant ordinarily enters through the openings in the lower end of the nose piece, passes upwardly around fuel elements 14, and discharges at upper outlet 13 in a partially vaporized condition for boiling water reactors or in an unvaporized condition for pressurized reactors at an elevated temperature.

The nuclear fuel elements or rods 14 are sealed at their ends by means of end plugs 18 welded to the cladding 17, which may include studs 19 to facilitate the mounting of the fuel rod in the assembly. A void space or plenum 20 is provided at one end of the element to permit longitudinal expansion of the fuel material and accumulation of gases released from the fuel material. A nuclear fuel material retainer means 24 in the form of a helical member is positioned within space 20 to provide restraint against the axial movement of the pellet column, especially during handling and transportation of the fuel element.

The fuel element is designed to provide an excellent thermal contact between the cladding and the fuel material, a minimum of parasitic neutron absorption, and resistance to bowing and vibration which is occasionally caused by flow of the coolant at high velocity.

Cladding 17 is produced in accordance with this invention by a process which includes in addition to the usual tube-forming operations a heat treatment above the alpha—alpha plus beta transformation temperature followed by a water quench. As so treated, the zirconium alloy body is made more easily workable and forming operations are facilitated through the warm-working stage. It also appears, as indicated above, that the physical properties and particularly the ductility of the ultimate cladding product may be considerably enhanced in this manner. As a further advantage, depending upon the nature of the finishing operations involved in producing the cladding, the tendency toward corrosion may be to a large extent suppressed as a consequence of the heat treatment above the alpha—alpha plus beta transformation temperature, which is 810° C. or higher, depending upon alloy composition. This latter effect would be attributable, possibly, to the segregation of the intermetallic phase at the grain boundaries. In any event, the zirconium alloy employed in this process is one which contains beryllium in amount from 0.05 to 0.25 weight percent, and preferably also contains about 1.5 weight percent tin and 0.05 weight percent nickel, and at least 95 weight percent zirconium. In other words, it is preferably either Zircaloy-2 or Zircaloy-4 type modified alloy.

What we claim as new and desire to secure by Letters Patent of the United States is:

1. A fast neutron-irradiated boiling water reactor structural component comprising a body of a zirconium-base alloy selected from the group consisting of Zircaloy-2 and Zircaloy-4 containing from 0.05 to 0.25 weight percent of a metal selected from the group consisting of yttrium, praseodymium, calcium, lanthanum and mixtures thereof and at least 95 weight percent zirconium and having a microstructure in which intermetallic phase is segregated at grain boundaries, said component having been treated at a temperature above 900° C. followed by quenching.

2. The method of producing a fast neutron-irradiated Zircaloy-4 nuclear fuel container which comprises the steps of forming an elongated tube of the zirconium-base alloy containing from 0.05 to 0.25 weight percent beryllium and at least 95 weight percent zirconium, heating the tube and thereby causing partial transformation of the alloy from alpha to beta phase, then quenching the tube and thereby producing throughout the tube a microstructure in which intermetallic phase is segregated at the grain boundaries, and thereafter subjecting the tube to boiling water reactor conditions for at least one year.

3. The method of claim 2 in which the tube heating step is carried out about 900° C. and the quenching step is a water quench.

* * * * *